US007896128B2

(12) United States Patent
De Leo et al.

(10) Patent No.: US 7,896,128 B2
(45) Date of Patent: Mar. 1, 2011

(54) AUTO-SENSING, AUTOMATIC ADJUSTING EXHAUST BAFFLE

(76) Inventors: Theodore De Leo, Fort Collins, CO (US); Richard S. Coate, Fort Collins, CO (US)

( * ) Notice: Subject to any disclaimer, the term of this patent is extended or adjusted under 35 U.S.C. 154(b) by 0 days.

(21) Appl. No.: 12/554,790

(22) Filed: Sep. 4, 2009

(65) Prior Publication Data

US 2010/0065365 A1 Mar. 18, 2010

Related U.S. Application Data

(60) Provisional application No. 61/095,535, filed on Sep. 12, 2008.

(51) Int. Cl.
*F01N 1/16* (2006.01)

(52) U.S. Cl. ..... 181/241; 181/254; 60/312

(58) Field of Classification Search ..... 181/215, 181/216, 226, 227, 228, 241, 254, 258, 264, 181/271, 277; 60/312, 322, 324
See application file for complete search history.

(56) References Cited

U.S. PATENT DOCUMENTS 3,346,071 A * 10/1967 Lader ..... 181/236
3,969,895 A * 7/1976 Krizman ..... 60/312
4,715,472 A * 12/1987 McKee ..... 181/241
4,903,486 A * 2/1990 Finkle ..... 60/324
4,966,253 A * 10/1990 Stephens et al. ..... 181/227
5,372,109 A * 12/1994 Thompson et al. ..... 123/323
6,367,580 B1 * 4/2002 Chang ..... 181/241
6,554,099 B2 * 4/2003 Uegane ..... 181/275
6,719,085 B2 * 4/2004 Lee ..... 180/309
6,848,252 B2 * 2/2005 Maybeck ..... 60/312
7,310,942 B2 * 12/2007 Shiga et al. ..... 60/324
2008/0135330 A1 * 6/2008 Wolf ..... 181/271

* cited by examiner

*Primary Examiner*—Elvin G Enad
*Assistant Examiner*—Jeremy Luks

(57) ABSTRACT

An auto-sensing, automatic adjusting exhaust baffle; for reducing noise emissions produced by internal combustion engines, while improving overall engine performance, i.e., torque and horsepower. The design uses a spherical shape to evacuate spent exhaust gas, thus scavenging the surrounding exhaust gases to adjust the backpressure, while reducing the noise exiting the exhaust pipe at lower rpm's. The device uses a sphere with an internal bearing; sliding linearly on a shaft and said sphere and bearing being acted upon by exhaust gasses and a compression spring mounted axially over the diameter of the shaft. The purpose of this device is to reduce noise while improving tuning of the air/fuel intake system, by adjusting backpressure of the exhaust system. The lesser amount of exhaust pressure, the less the sphere moves, as in idle to just off of idle, this results in a quiet operational mode of the invention. As more exhaust pressure is presented, as in higher throttle positions, the more the sphere moves away from the discharge ports, the louder the sound will be from the exit end of the exhaust pipe, this results in the active mode of the invention, obtaining the desired sound and adjusted back-pressure throughout the power band.

11 Claims, 7 Drawing Sheets

AUTO-SENSING, AUTOMATIC ADJUSTING EXHAUST BAFFLE

CROSS-REFERENCE TO RELATED APPLICATIONS

The application claims domestic priority from U.S. Provisional Application No. 61/096,535 filed Sep. 9, 2008.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE INVENTION

The present invention relates generally to and more specifically it relates to exhaust baffles, and in particular to such baffles which are responsive to the exhaust characteristics of a combustion engine.

BACKGROUND OF THE INVENTION

The present day motorcycle enthusiast on many occasions, remove the stock baffles that are located within the exhaust pipe. The objective of such action is an attempt to improve the sound that is emitted from the exhaust pipe. The sound emitted is a pressure wave that builds from alternating low and high air pressure that moves at the speed of sound. Such an arrangement, which typically is referred to as open drag pipe, is typically a configuration that will not only reduce performance in the low to mid range of the RPM band, it will typically increase the noise level being emitting from the open exhaust pipe, which is generally beyond the acceptable audible limits. On the other hand the correct amount of backpressure is required for a combustion engine to work efficiently through out all operating conditions, but too much backpressure is the result of a restrictive exhaust system. When spent gases cannot flow freely through the exhaust system because of restrictions, as with a stock static baffle, they cause exhaust gases to back up into the combustion chamber in the higher RPM range. Since the gases cannot escape at the proper velocity, your engine has to work harder without yielding greater power. In general, you lose horsepower, torque and fuel economy. This invention provides a solution to both issues, the improved sound motorcycle enthusiasts are demanding, while providing improved performance thru out the power band. The present baffle invention is located within the end of the exhaust pipe to create a vacuum, thus increasing the flow of spent exhaust gas, this action scavenges the surrounding exhaust gases to adjust the backpressure and reversion, while quieting the resonance of noise exiting the exhaust chamber in the lower rpm range. In the mid to upper RPM band the baffle changes position to allow for the deep throaty sound, that motorcycle enthusiast enjoy. When an exhaust system is properly tuned, engine scavenging can greatly increase efficiency and horsepower because it helps pull exhaust out of the other cylinders to allow for a clean air/fuel charge. This invention comprehends usage in all types of internal combustion engine installations, automobiles, trucks, and motorcycles. The inventors herein has found that by installing this invention inside the exhaust pipe, it can be made to be responsive to engine performance in such a way as to improve the engine's efficiency and output by providing an auto-adjustable baffle within the end of the exhaust pipe. It is an object of this invention is to accomplish this objective with a baffle, which is responsive to the performance of the engine. This is the first product that has been able to consistently address the above issues and remedy them.

BRIEF SUMMARY OF THE INVENTION

An objective of the invention is to overcome at least some of the drawbacks relating to the compromise designs of aftermarket exhaust pipes that have had the stock baffles removed. The invention generally relates to a responsive exhaust baffle, generally for motorcycle exhaust pipes, and is especially applicable to aftermarket motorcycle exhaust pipes with a straight-through pipe design. The current embodiment of the invention, when used allows for carefree automatic tuning of the motorcycle exhaust, thru out the power band, referred to herein as auto-sensing, automatic adjusting exhaust baffle. While obtaining the desired sound and power, the user will have the additional benefit of an enhanced throttle response.

There has thus been outlined, rather broadly, some of the features of the invention in order that the detailed description thereof may be better understood, and in order that the present contribution to the art may be better appreciated. There are additional features of the invention that will be described hereafter.

In this respect, before explaining at least one embodiment of the invention in detail, it is to be understood that the invention is not limited in its application to the details of construction or to the arrangement of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a auto-sensing, automatic adjusting exhaust baffle, for reducing noise level emissions produced by internal combustion engines, while improving overall engine performance, i.e., torque and horsepower and improved engine performance throughout the power band. According to the invention, a flow passage is formed between an inlet and an outlet, which opens into a region at ambient pressure. The auto-sensing, automatic adjusting exhaust baffle uses a main cylindrical disk body that acts not only as an spent exhaust gas conduit, it acts as a mechanical support for the shaft and sphere assembly, said sphere assembly houses a pressed internal bearing, sliding linearly on a shaft, and said sphere and bearing being acted upon by a compression spring mounted axially over the diameter of the shaft. The auto-sensing, automatic adjusting exhaust baffle uses a spring loaded spherical shape to evacuate spent exhaust gas, thus scavenging the surrounding exhaust gases to adjust the backpressure, while quieting the resonance of noise exiting the exhaust pipe at lower rpm's. It may also be contained in a static position by fixing it in place with a fastening device, rather than sliding along linearly. This optional positioning will provide for a quieter operation thru out the power band.

Another objective is to provide an auto-sensing, automatic adjusting exhaust baffle, that will not hinder the low rumble sound inherent to most V-Twin engines, but its use is not limited to these two cylinder type engines alone and may lend its use to all internal combustion engines.

Various other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawing are illustrative only, and that the changes may be made in the specific construction illustrated and described within the scope of this application.

BRIEF DESCRIPTION OF THE SEVERAL VIEWS OF THE DRAWINGS

Various other objects, features and attended advantages of the present invention will become fully appreciated as the same becomes better understood when considered in conjunction with the accompanying drawing, in which like reference characters designate the same or similar parts throughout the several views. Having thus described the invention in general terms, reference will now be made to the accompanying drawings, which are not necessarily drawn to scale, and wherein.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
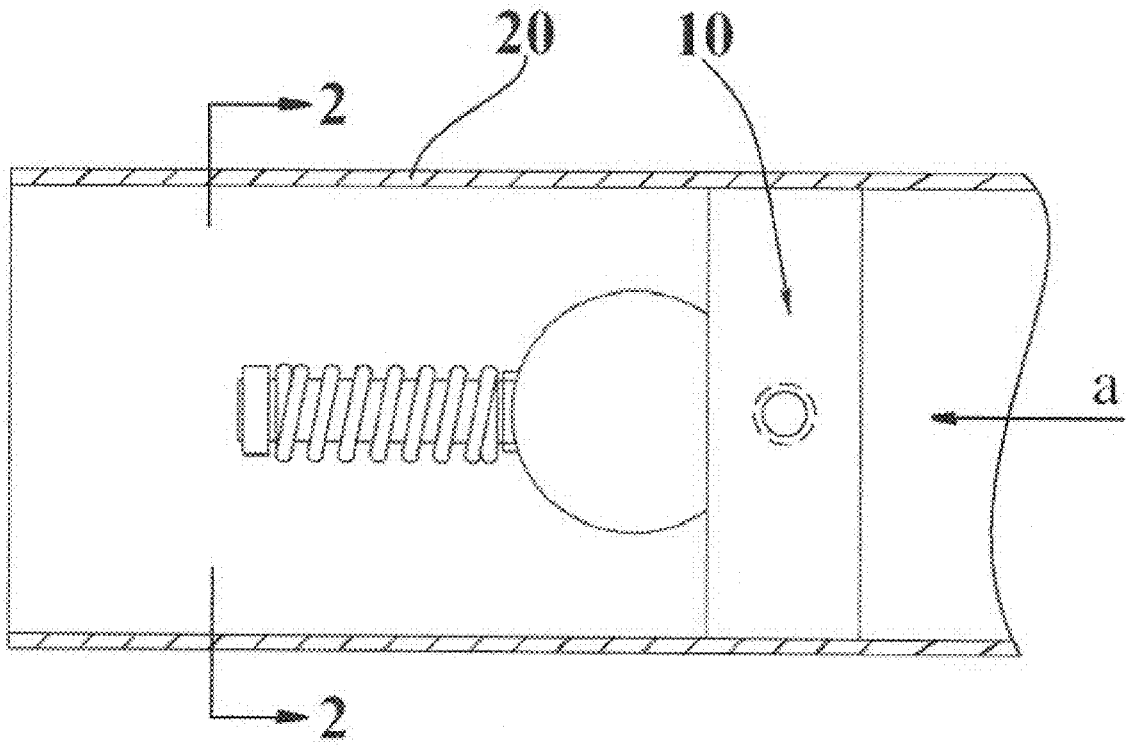
FIG. 1 schematically illustrates a side cross sectional view of a motorcycle exhaust pipe showing where the auto-sensing, automatic adjusting exhaust baffle is located within the exhaust pipe incorporating a preferred embodiment of the present invention.
Figure 2:
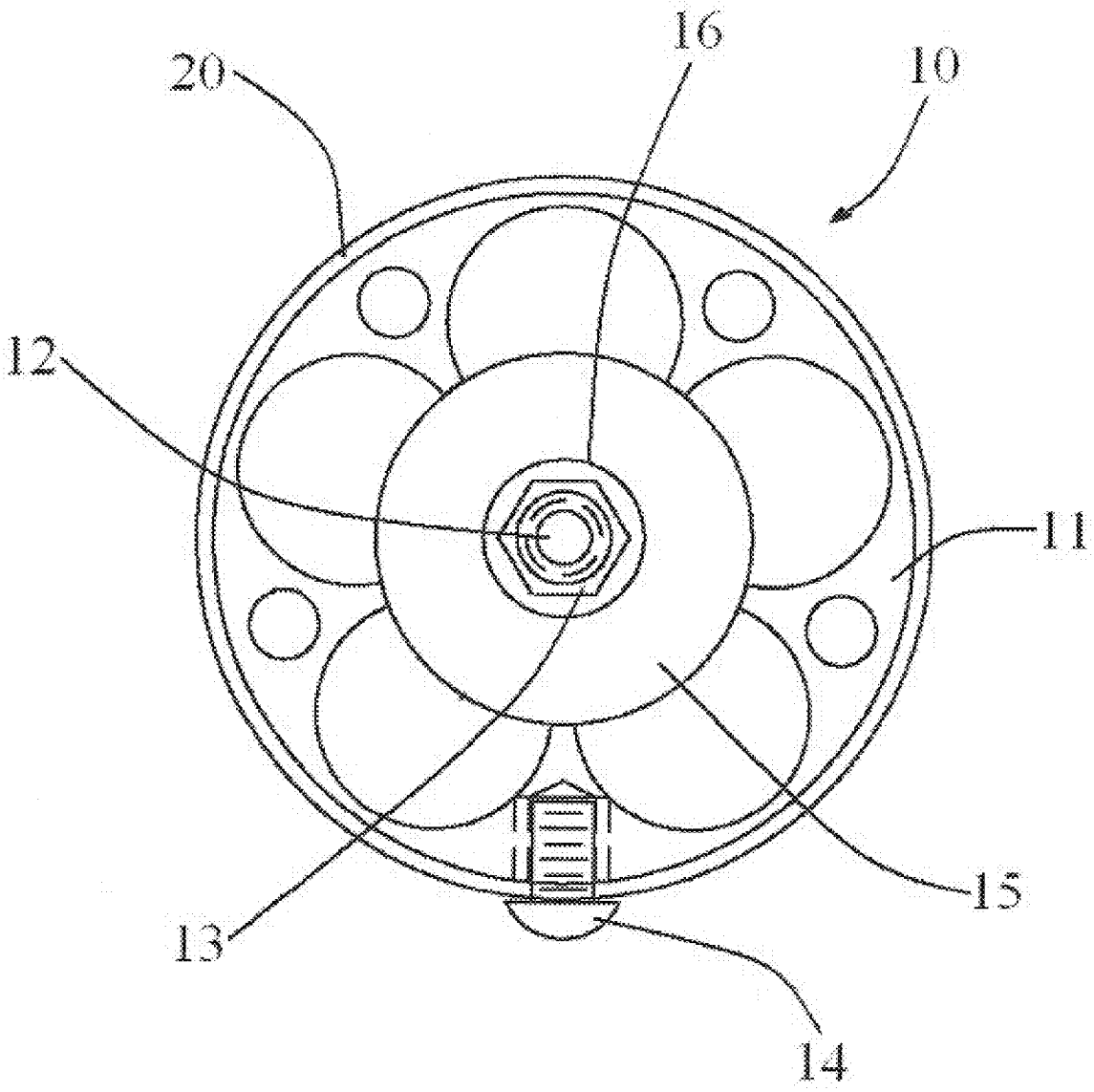
FIG. 2 is a end cross sectional view of said, auto-sensing, automatic adjusting exhaust baffle taken substantially along the line 2-2 in FIG. 1 and showing the auto-sensing, automatic adjusting exhaust baffle located in the exhaust pipe.

Turning now descriptively to the drawings referring to FIGS. 1 and 2, in which similar reference characters denote similar elements throughout the several views, the figures illustrate a main cylindrical disk body 11 that contains a spring 16, linear glide sphere 15 that moves along a shaft 12 according to the exhaust gas backpressure and varying flow rates. Exhaust gasses flow in a direction indicated by an arrow a, into said main cylindrical disk body 11 via the exhaust pipe 20, connected to an combustion engine (not shown).

The main cylindrical disk body 11 is made from a stock of machined billet aluminum or carbon steel. The many functions of the main cylindrical disk body 11 are; to hold in place the auto-sensing, automatic adjusting exhaust baffle inside said exhaust pipe 20, located approximately four to five inches inside from the exit end of said exhaust pipe 20, containing the necessary tapped features 19, to mount said main cylindrical disk body to said exhaust pipe 20, to channel the exhaust gases into the chamber to active the variable glide sphere 15.

Machined billet aluminum or carbon steel with pre-determined holes sizes and angles that force the exhaust gases onto the variable glide sphere 15 without inhibiting the engines performance. The main cylindrical disk body 11 contains all of the necessary features to mount all of the sub-elements listed in the parts list.

Possible variations that can take place are, various sizes of main cylindrical disk body 11, multiple inlets sizes, variable glide sphere 15 sizes, and spring 16 loads that are required for the many different diameters of exhaust pipes 20.

Auto-sensing, automatic adjusting exhaust baffle uses a variable glide sphere 15 with an internal bearing 17, sliding linearly on a shaft 12 and said variable glide sphere 15 and bearing 17 being acted upon by a compression spring 16 mounted axially over the diameter of the shaft 12. The variable glide sphere 15 is held in place, inside the housing with a shaft 12 as its guide. Its rate of movement is controlled by a high temperature spring 16 for return to the home position. A high temperature spring washer 18 is used to cushion the return action of the sphere 15 once it's in home the position.

Figure 3:
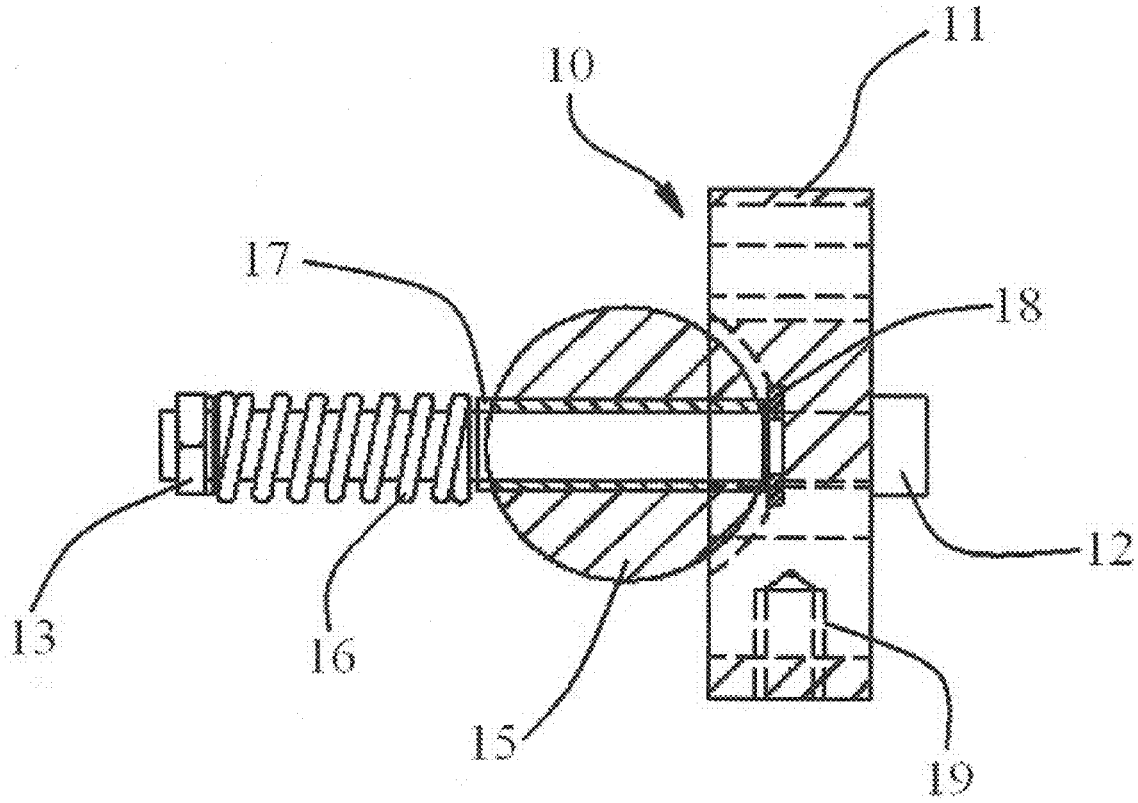
FIG. 3 is a side cross-sectional view of said, auto-sensing, automatic adjusting exhaust baffle with the main cylindrical disk body shown. This is what is place into the exit end of the exhaust pipe and secured by a screw where the stock baffles were located.
Figure 4:
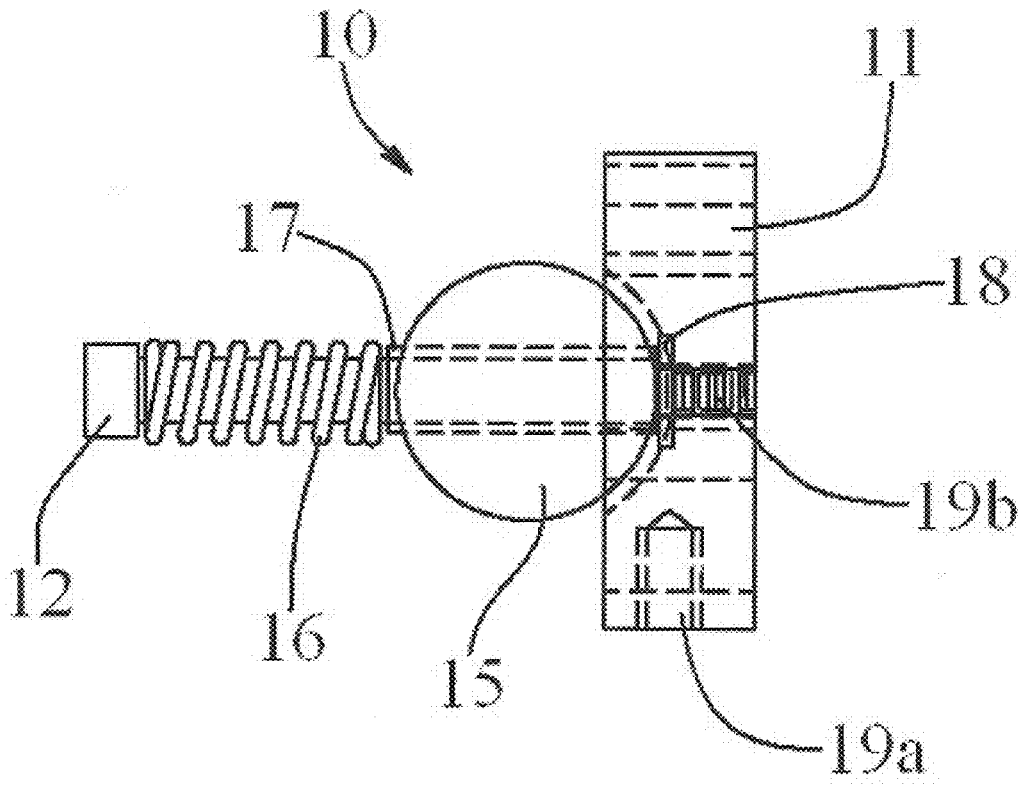
FIG. 4 is a side cross sectional view of said, auto-sensing, automatic adjusting exhaust baffle with the main cylindrical disk body shown, demonstrating an alternate position of a front captured shaft.
Figure 5:
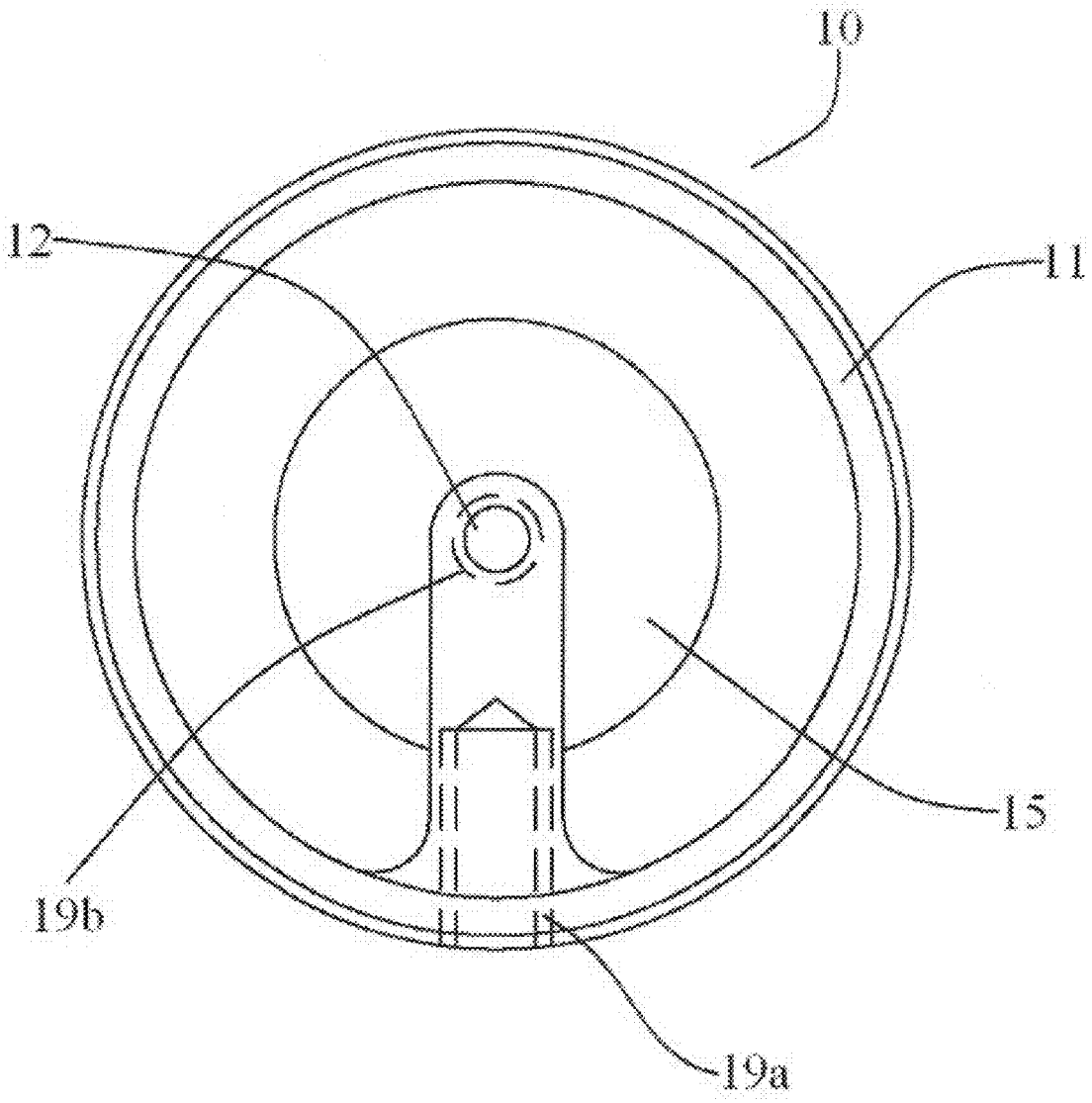
FIG. 5 is an end view of an, auto-sensing, automatic adjusting exhaust baffle device, in accordance with an alterative embodiment of the invention.
Figure 6:
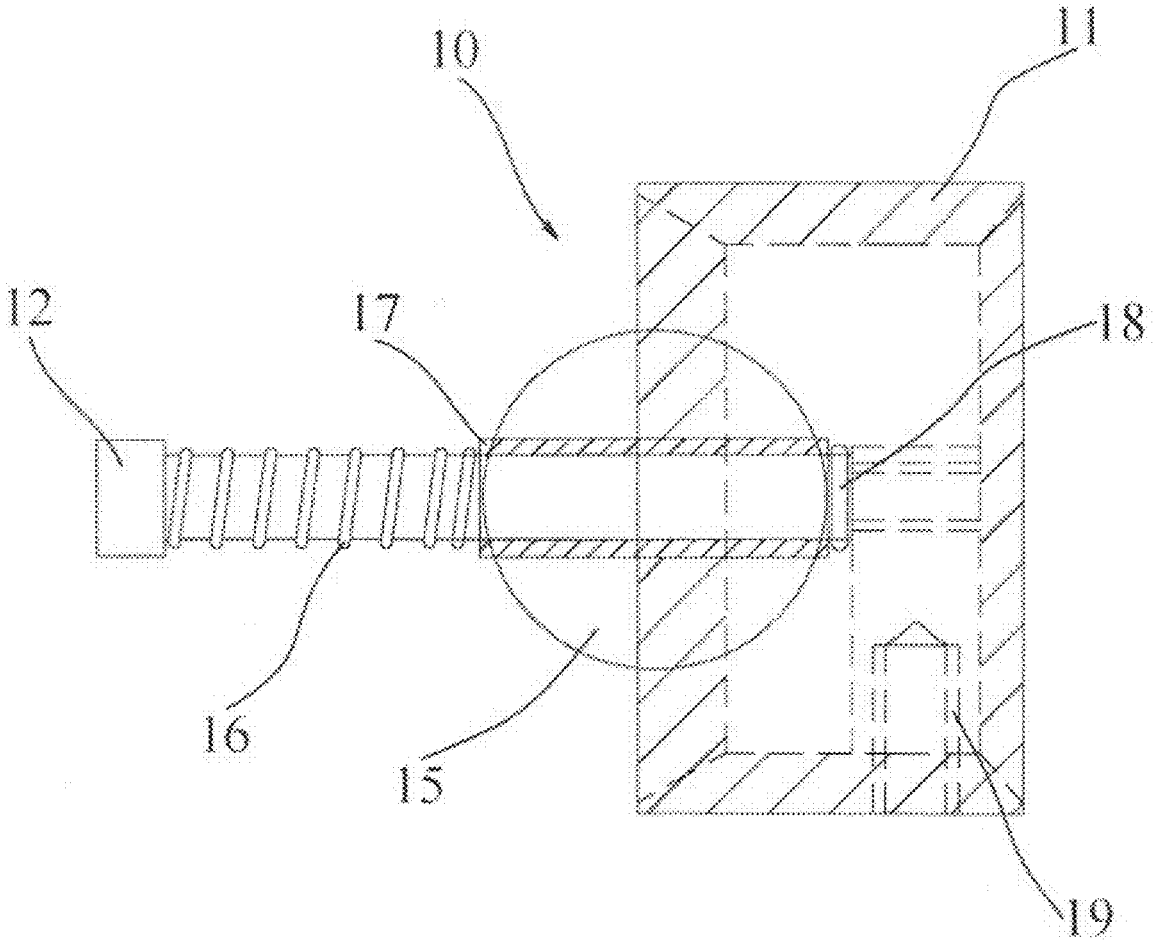
FIG. 6 is a side cross-sectional view of said, auto-sensing, automatic adjusting exhaust baffle device, alternate embodiment of FIG. 5.
Figure 7:
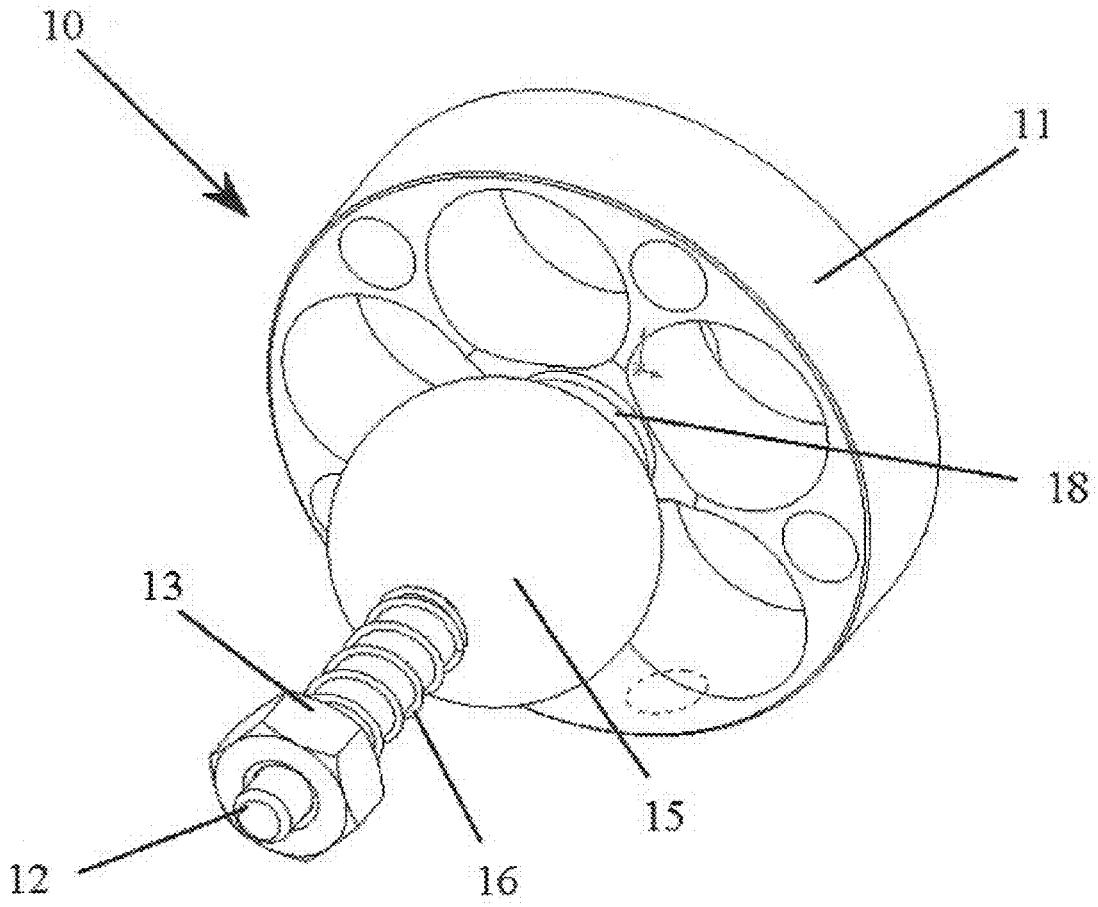
FIG. 7 is an isometric view of said preferred embodiment, of said auto-sensing, automatic adjusting exhaust baffle device of FIG. 3.

Various mounting schemes as seen in FIGS. 3-4, for containing the variable glide sphere 15, may be used to fashion said sphere 15 to the main cylindrical disk body 11.

The device slides into place, via the output end of the straight exhaust pipe 20. It is held in place to the aftermarket or stock exhaust pipe, by a ¼×20 SS screw 14. Exhaust gases flow through said exhaust pipe 20 and as the exhaust gases build up against the variable glide sphere 15, thus moving it against the spring 16. The force to move the spring 16 loaded sphere 15 is based solely on how much exhaust gas pressure is present in the exhaust chamber. The lesser amount of exhaust pressure, the less the sphere 15 moves, as in idle to just off of idle, this results in the quiet operation mode of the invention. More exhaust pressure, as in higher throttle positions, the louder the sound will be coming from the exhaust pipe, this results in the active mode of the invention.

The introduction of the sphere 15 into the path of exhaust gases also improves mid-range torque and horsepower over straight exhaust pipes 20. The principle dynamic's of the sphere 15 will increase the flow of exhaust gases, thus reducing the effort the engine needs to work to produce power at off idle throttle positions.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the sprit and scope of the invention in which all terms are meant in their broadest, reasonable sense unless other wise indicated. Any headings utilized within the description are for convenience only and have no legal or limiting effect.

That which is claimed:

1. An auto-sensing, automatic adjusting exhaust baffle, reactive, regulating element to the exhaust gas stream for an internal combustion engine, comprising: a main cylindrical disk body; wherein a flow passage is formed between an inlet and an outlet; having multiple inlet holes, thus forming internal pathways leading to discharge ports; designed to receive and to discharge the exhaust gas stream, configured to be received within an exhaust pipe adjacent to the exit end of the exhaust pipe, and a variable regulating element, being a sphere, being positioned centrally downstream from said discharge ports through which said exhaust gas stream must flow about, said sphere including an operating means for linear movement along the centrally-mounted shaft causing a varying increase or decrease in the amount of exhaust gas and gas pressure delivered by said combustion engine and passing through the device; and a linear motion mechanism with a centrally mounted shaft and spring return to allow said sphere to move towards or away from said main cylindrical disc body, causing an increased or decreased restriction in the exhaust gas flow and pressure.

2. An auto-sensing, automatic adjusting exhaust baffle according to claim 1, in which said regulating element opens or closes as a function of an increase or decrease in a internal combustion engine exhaust flow rate.

3. An auto-sensing, automatic adjusting exhaust baffle according to claim 1, in which said regulating element comprises said shaft mounted in stationary fashion relative to said main cylindrical disk body, downstream from said inlet holes and directed toward said discharge port, said sphere mounted on said shaft and movable toward or away from said discharge ports.

4. An auto-sensing, automatic adjusting exhaust baffle according to claim 1, wherein the sphere member has an outer diameter of less than the inner diameter of the inside diameter of the exhaust pipe.

5. An auto-sensing, automatic adjusting exhaust baffle according to claim 1, in which said sphere surface description may be smooth in nature or may contain any number of surface features, structured to attract friction.

6. An auto-sensing, automatic adjusting exhaust battle according to claim 1, wherein said spring is a mechanical spring.

7. An auto-sensing, automatic adjusting exhaust baffle according to claim 6, in which said spring element and sphere combination is responsive to an engine operating condition.

8. An auto-sensing, automatic adjusting exhaust baffle according to claim 3, wherein the inlet ports in said main cylindrical disk are tapered inwardly from said inlet holes toward said discharge ports, whereby a cross section of said passageway decreases or increases with distance from said discharge port.

9. An auto-sensing, automatic adjusting exhaust baffle according to claim 1, including a threaded mounting hole provided in said main cylindrical disk body adapted for receiving a threaded fastener for securing the device within the exhaust pipe.

10. An auto-sensing, automatic adjusting exhaust baffle according to claim 1, additionally including a threaded lock nut, threaded onto a threaded end portion of said shaft and tightened against a shoulder of said shaft.

11. An auto-sensing, automatic adjusting exhaust baffle device for an exhaust pipe, comprising a main cylindrical disk body formed of metal, said main cylindrical disk body having end portions of uniform diameter joined by an integral central portions of uniform diameter, multiple holes formed in said main cylindrical disk body, an attached shaft positioned over said center hole on the interior of said main cylindrical disk body and secured in place at a first end by threading, welding or press fitting, a sphere element positioned for engagement onto said first shaft, having a spring element positioned downstream of said sphere element, having threads configured for engagement with a first threaded nut for securing said sphere and said spring to said shaft, said main cylindrical disk body having threads configured for engagement with a first threaded hole for securing the auto-sensing, automatic adjusting exhaust baffle device inside the exhaust pipe, and projecting into the interior thereof and into a path of exhaust gases there through.

* * * * *